US007712167B2

(12) United States Patent
Guguin et al.

(10) Patent No.: US 7,712,167 B2
(45) Date of Patent: May 11, 2010

(54) PATIENT BED WITH A RETRACTABLE SIDE BARRIER

(75) Inventors: Pascal Guguin, Brech (FR); Thierry Jaffre, Pluvigner (FR); Philippe Kaikenger, Paris (FR)

(73) Assignee: Hill-Rom S.A.S., Pluvigner (FR)

( * ) Notice: Subject to any disclaimer, the term of this patent is extended or adjusted under 35 U.S.C. 154(b) by 0 days.

(21) Appl. No.: 12/166,892

(22) Filed: Jul. 2, 2008

(65) Prior Publication Data

US 2009/0007333 A1 Jan. 8, 2009

(30) Foreign Application Priority Data

Jul. 6, 2007 (FR) ..... 07 56317

(51) Int. Cl.
*A61G 7/05* (2006.01)

(52) U.S. Cl. ..... 5/430; 5/429

(58) Field of Classification Search ..... 5/425–430
See application file for complete search history.

(56) References Cited

U.S. PATENT DOCUMENTS

| | | | |
|---|---|---|---|
| 2,195,955 | A | 4/1940 | Hillenbrand |
| 2,478,028 | A | 8/1949 | Travis |
| 2,587,291 | A | 2/1952 | Des Rochers |
| 2,658,211 | A | 11/1953 | Bendersky |
| 2,676,341 | A | 4/1954 | Leone et al. |
| 2,722,017 | A | 11/1955 | Burst et al. |
| 2,766,463 | A | 10/1956 | Bendersky |
| 2,817,854 | A | 12/1957 | Pratt |
| 2,817,855 | A | 12/1957 | Pratt |
| 2,871,490 | A | 2/1959 | Balonick |
| 3,002,200 | A | 10/1961 | Murcott |
| 3,012,255 | A | 12/1961 | Diehl |
| 3,023,781 | A | 5/1962 | Constanti |
| 3,045,259 | A | 7/1962 | Mayer |
| 3,055,020 | A | 9/1962 | Mann |
| 3,081,463 | A | 3/1963 | Williams et al. |
| 3,220,024 | A | 11/1965 | Nelson |
| 3,419,922 | A | 1/1969 | Malherbe |
| 3,506,989 | A | 4/1970 | Ross et al. |
| 3,526,008 | A | 9/1970 | Pruim |
| 3,585,659 | A | 6/1971 | Burst et al. |
| 3,641,598 | A | 2/1972 | Feldstein |
| 3,840,917 | A | 10/1974 | Taylor |
| 3,851,345 | A | 12/1974 | Benoit et al. |
| 3,855,654 | A | 12/1974 | Pivacek |
| 3,865,434 | A | 2/1975 | Sully |
| 3,930,273 | A | 1/1976 | Stern |
| 3,932,903 | A | 1/1976 | Adams et al. |

(Continued)

FOREIGN PATENT DOCUMENTS

DE 3510707 A1 10/1986

(Continued)

*Primary Examiner*—Michael Trettel
(74) *Attorney, Agent, or Firm*—Barnes & Thornburg LLP

(57) ABSTRACT

A bed with a movable side barrier comprising a main barrier element and a bottom extender is disclosed. The main barrier element is associated with a deformable parallelogram mechanism hinged to a frame of the bed, said mechanism includes a deployment bar hinged between two parallel arms, and the bottom extender is attached to the deployment bar via a horizontally-sliding connection and is constrained to slide along vertical guide means carried by the main barrier element.

20 Claims, 7 Drawing Sheets

U.S. PATENT DOCUMENTS

| | | | | | |
|---|---|---|---|---|---|
| 3,971,083 | A | | 7/1976 | Peterson | |
| 4,103,376 | A | | 8/1978 | Benoit et al. | |
| 4,183,015 | A | | 1/1980 | Drew et al. | |
| 4,186,456 | A | | 2/1980 | Huempfner | |
| 4,612,679 | A | | 9/1986 | Mitchell | |
| 4,641,385 | A | | 2/1987 | Peters et al. | |
| 4,653,129 | A | | 3/1987 | Kuck et al. | |
| 4,747,171 | A | * | 5/1988 | Einsele et al. | 5/425 |
| 4,949,410 | A | | 8/1990 | Failor et al. | |
| 4,985,946 | A | | 1/1991 | Foster et al. | |
| 4,987,623 | A | | 1/1991 | Stryker et al. | |
| 4,993,089 | A | | 2/1991 | Solomon et al. | |
| 5,044,025 | A | * | 9/1991 | Hunsinger et al. | 5/424 |
| 5,083,334 | A | | 1/1992 | Huck et al. | |
| 5,129,117 | A | | 7/1992 | Celestina et al. | |
| 5,187,824 | A | | 2/1993 | Stryker | |
| 5,394,580 | A | | 3/1995 | Foster et al. | |
| 5,604,942 | A | | 2/1997 | Allevato et al. | |
| 5,732,423 | A | | 3/1998 | Weismiller et al. | |
| 5,784,732 | A | | 7/1998 | Vail | |
| 5,802,636 | A | | 9/1998 | Corbin et al. | |
| 5,878,452 | A | | 3/1999 | Brooke et al. | |
| 6,021,533 | A | | 2/2000 | Ellis et al. | |
| 6,167,580 | B1 | | 1/2001 | Draheim et al. | |
| 6,182,310 | B1 | | 2/2001 | Weismiller et al. | |
| 6,253,397 | B1 | | 7/2001 | Bartow et al. | |
| 6,360,385 | B1 | | 3/2002 | Lewandowski | |
| 6,397,416 | B2 | | 6/2002 | Brooke et al. | |
| 6,446,283 | B1 | | 9/2002 | Heimbrock et al. | |
| 6,622,323 | B2 | | 9/2003 | Zerhusen et al. | |
| 6,640,361 | B2 | | 11/2003 | Heimbrock et al. | |
| 6,658,680 | B2 | | 12/2003 | Osborne et al. | |
| 6,691,345 | B2 | * | 2/2004 | Nanahara | 5/430 |
| 6,751,815 | B2 | | 6/2004 | Heimbrock et al. | |
| 6,779,209 | B2 | | 8/2004 | Ganance | |
| 6,829,793 | B2 | | 12/2004 | Brooke et al. | |
| 6,851,142 | B2 | | 2/2005 | Stryker et al. | |
| 6,874,179 | B2 | | 4/2005 | Hensley et al. | |
| 6,938,289 | B2 | | 9/2005 | Morin | |
| 6,951,036 | B2 | | 10/2005 | Lemire | |
| 7,028,352 | B2 | | 4/2006 | Kramer et al. | |
| 7,073,220 | B2 | | 7/2006 | Simmonds et al. | |
| 7,082,630 | B2 | | 8/2006 | Castonguay et al. | |
| 7,107,637 | B2 | | 9/2006 | Kuek et al. | |
| 7,412,734 | B2 | | 8/2008 | Stryker et al. | |
| 7,467,427 | B1 | * | 12/2008 | Wu et al. | 5/425 |
| 2002/0144348 | A1 | | 10/2002 | Ganance | |
| 2005/0166320 | A1 | * | 8/2005 | Lemire | 5/425 |
| 2006/0179569 | A1 | * | 8/2006 | Vrzalik et al. | 5/430 |
| 2009/0007334 | A1 | | 1/2009 | Stryker et al. | |

FOREIGN PATENT DOCUMENTS

| | | | |
|---|---|---|---|
| EP | 0 680 714 | A1 | 11/1995 |
| EP | 1 053 735 | A2 | 11/2000 |
| EP | 1 108 410 | A2 | 6/2001 |
| EP | 1 243 207 | A1 | 9/2002 |
| JP | 09206177 | A | 8/1997 |
| JP | 09276340 | A | 10/1997 |
| WO | WO 98/17153 | | 4/1998 |
| WO | WO 02/32271 | A1 | 4/2002 |
| WO | WO 03/070061 | A1 | 8/2003 |
| WO | WO 2005-092153 | | 10/2005 |
| WO | WO 2007/019692 | A1 | 2/2007 |

* cited by examiner

PATIENT BED WITH A RETRACTABLE SIDE BARRIER

BACKGROUND

The present application claims priority, under 35 U.S.C. §119(a), of French National Application No. 07 56317 which was filed Jul. 6, 2007, which published as French Patent Application Publication No. 29 18 256 on Jan. 9, 2009, and which is hereby incorporated by reference herein.

BACKGROUND

The present disclosure relates to a bed having a retractable side barrier, in particular a bed for a patient; the disclosure relates more particularly to an apparatus for enabling the height of the protection provided by said barrier to be increased, other things remaining equal.

A patient bed is known that is fitted with a side barrier mounted along a bedstead or frame of the bed. To give access to the bed in order to provide care, it is known to combine such a barrier with a deformable parallelogram mechanism having two pivot arms connected to the stationary frame of the bed or to an equivalent structure. Under such conditions, the barrier can be lowered or raised, substantially parallel to itself, the movement being accompanied by a movement in translation and rotation parallel to the longitudinal direction of the bed. In such a mechanism, it is desirable to increase the distance between the top bar of the barrier in the raised position and the bedding plane. Nevertheless, in this position, the bottom edge of the barrier should not be situated too high.

Furthermore, in the low position, the bottom edge of the barrier should be at a sufficient distance from the floor. These requirements are specified by a standard. Taking all of these constraints into account would lead to the height of the bedding plane to be raised in order to be able to associate a higher barrier with the bed. That is not desirable since said bedding plane needs to be relatively low in order to reduce the risk of injury if a patient falls out of bed, and in order to make it easier to move the patient out from the bed or to put the patient into the bed.

From a mechanical point of view, it is known to associate the deformable parallelogram mechanism with a bottom bar that is hinged to the two arms via its two ends. This bar is referred to herein as a deployment bar and it serves to make the movements of the mechanism more reliable by avoiding jamming. Conventionally, the bar is installed in a box that is fixed under the frame of the bed and that occupies a relatively large volume.

Document EP 1 053 735 describes a barrier that is hinged in its own plane and that comprises two portions, a bottom portion and a top portion that are approximately L-shaped. The dynamics of the deployment system are such that the two portions are further apart from each other when the barrier is in its high position than when it is in its low position. The space between the two portions can give rise to an accident. In addition, when the barrier is in its low position, it occupies a relatively large amount of space longitudinally.

The devices disclosed herein seek to reconcile all of the above-mentioned requirements while avoiding the above-analyzed drawbacks of the prior art device.

SUMMARY

Disclosed herein is a bed with a retractable side barrier of the type comprising a main barrier element associated with a deformable parallelogram mechanism hinged to a frame of the bed or to an analogous structure, said mechanism comprising two parallel arms, each including a hinge to said frame and a hinge to said main barrier element, a deployment bar being additionally hinged between said arms, wherein said mechanism is associated with a bottom extender attached to said deployment bar by a sliding connection, and wherein said extender is constrained to slide along vertical guide means carried by said main barrier elements.

By way of example, said extender may be carried by two pins each secured to the deployment bar, each pin being engaged in a respective slot of the extender. The arrangement could naturally be inverted.

Locking means (that do not form part of the invention and that are not described in detail below) are provided in order to define high and low stable positions, and possibly also an intermediate stable position for the main barrier elements, and consequently also for the extender, which in one possible embodiment can be deployed downwards when the main barrier element is in its high position, and on the contrary retracted into the main barrier element when the barrier element is in its low position.

BRIEF DESCRIPTION OF THE DRAWINGS

The devices disclosed herein can be better understood on reading the following description of side-barrier beds in accordance with this disclosure, given purely by way of example, and made with reference to the accompanying drawings, in which.

DETAILED DESCRIPTION

Figure 5:
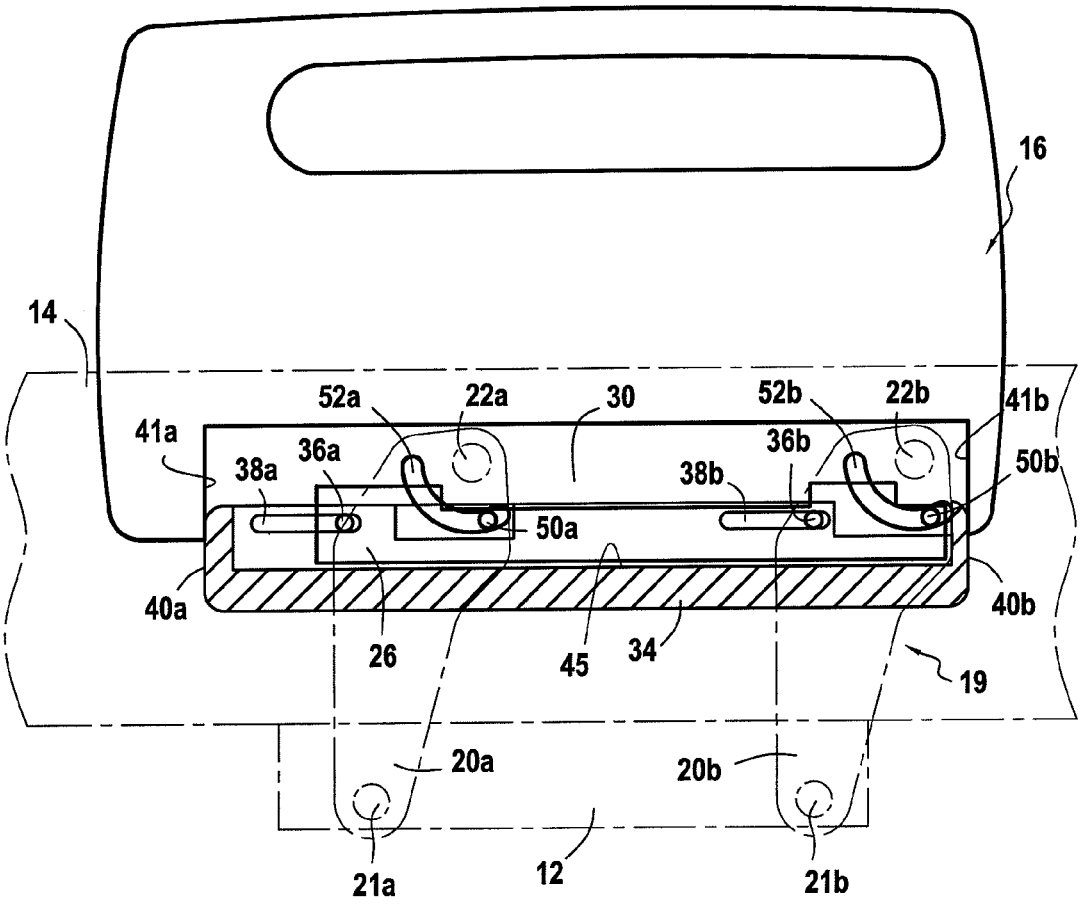
FIGS. 5 to 7 are diagrammatic views of the embodiment of FIG. 1, showing the dynamics of the system.
Figure 6:
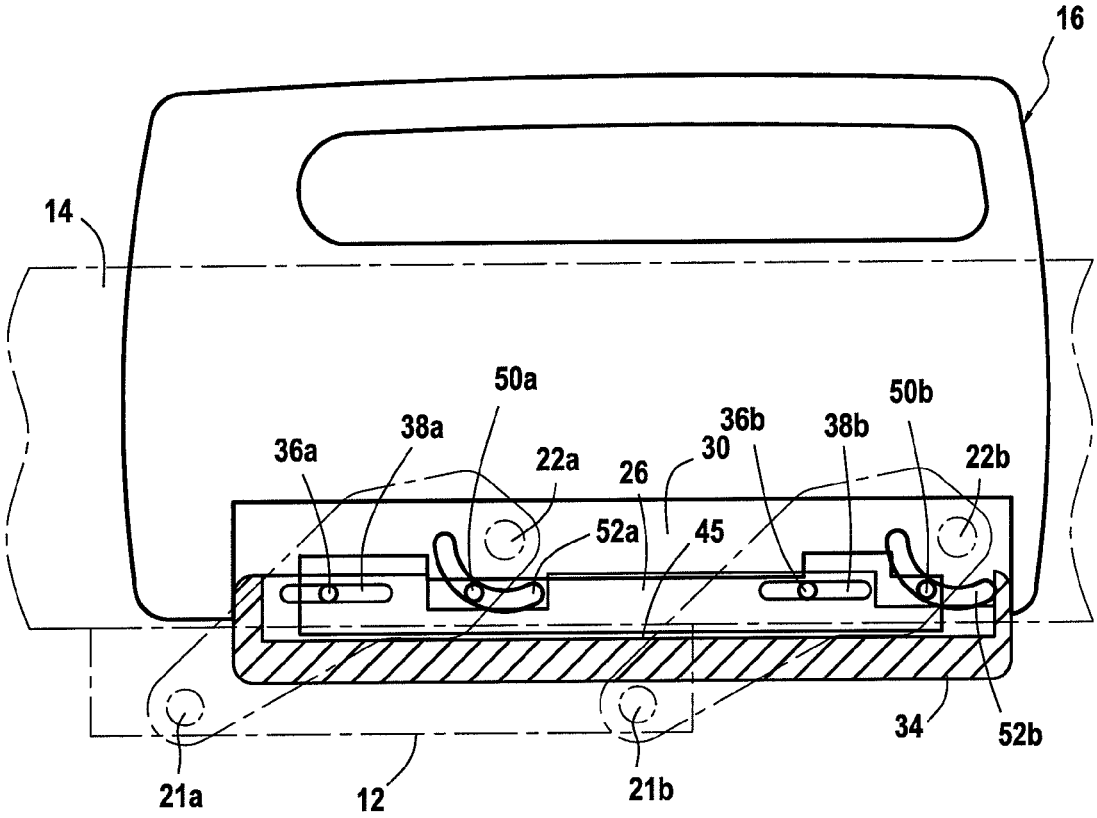
Figure 7:
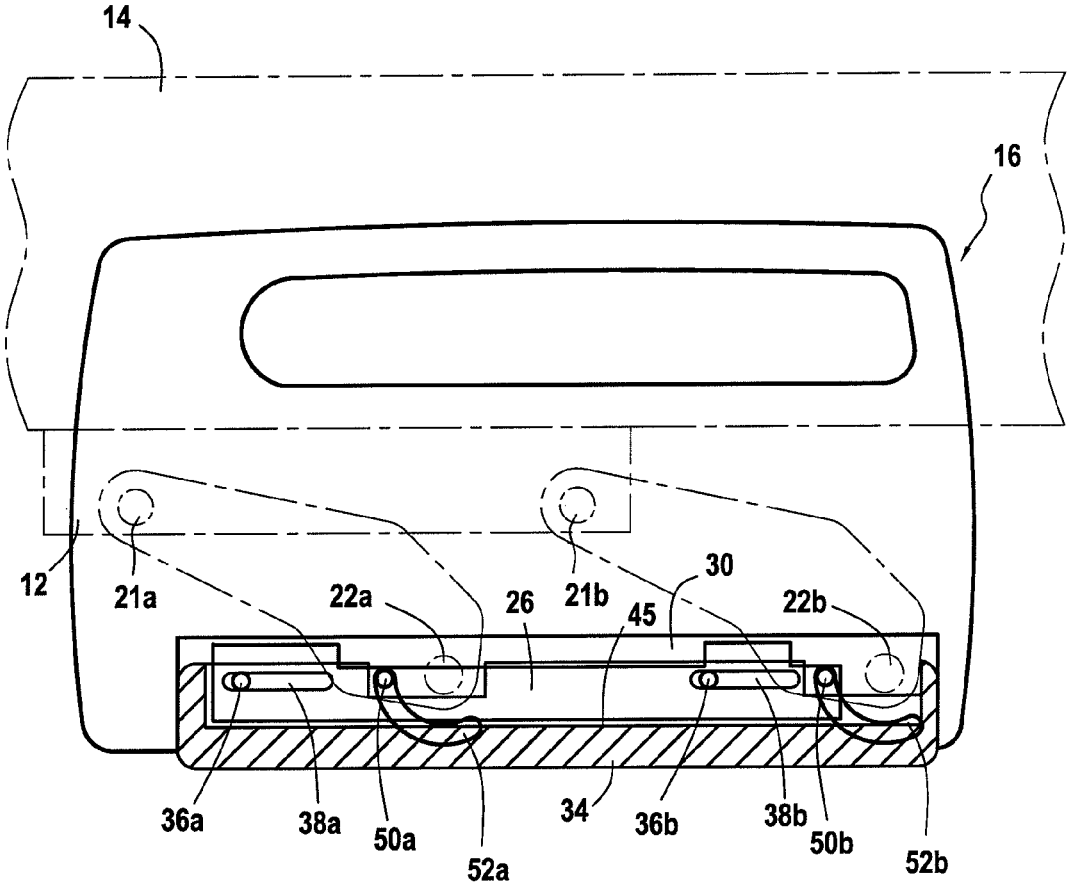

In the drawings, there can be seen a diagram showing part of a bed 11 comprising a bedstead or frame 12 that is stationary and that supports a bedding plane having a mattress 14 placed thereon. A retractable side barrier 16 is arranged on the side of the bed and can move with general rotation-translation movement between a high position (FIG. 5) and a low position (FIG. 7). FIG. 6 shows an intermediate position. The barrier 16 comprises a main barrier element 18 associated with a deformable parallelogram mechanism 19 hinged to the frame 12 of the bed. The mechanism has two parallel pivot arms 20*a*, 20*b* each having a hinge 21*a*, 21*b* with said frame and a hinge 22*a*, 22*b* with the main barrier element. In addition, and in known manner, a deployment bar 26 is hinged between said arms 20*a*, 20*b*, by means of two hinge pins 50*a*, 50*b* in the example shown.

In the example described with reference to FIGS. 1 to 3 and 5 to 7, the mechanism comprises a longitudinal support 28 fastened to the bottom portion of the main barrier element 18 and forming an integral portion thereof. This longitudinal support co-operates with the main barrier element 18 to define a cavity 30 presenting a longitudinal opening 32 that extends along its bottom edge.

According to one disclosed characteristic, the mechanism is associated with a bottom extender 34 carried by two pins

36*a*, 36*b* that are spaced apart and secured to said deployment bar 26. Said extender 34 extends over practically the entire length of the main barrier element. It is attached to the deployment bar 26 via a sliding connection. Thus, the pins 36*a*, 36*b* are engaged in corresponding slots 38*a*, 38*b* of the extender 34. The extender is constrained to slide along vertical guide means carried by said main barrier element. More precisely, these guide means are constituted in this example by walls inside the cavity 30, which houses the top portion of the extender. In the example, the ends 40*a*, 40*b* of said extender that are longitudinally spaced apart come into sliding contact with two corresponding end walls 41*a*, 41*b* of the cavity 30. The cavity also houses the deployment bar 26 to which the extender 34 is attached. In the example described, the deployment bar 26 is horizontal as is the sliding connection (36*a*, 38*a*-36*b*, 38*b*), but that is not essential, it being possible for the arrangement to slope somewhat.

In the example, the two parallel arms 20*a*, 20*b* are outside the cavity defined by the support 28. They extend between the edge of the bed and the main barrier element 18 proper.

The extender 34 extends a little beyond the bottom longitudinal opening 32 of the cavity, through a distance that depends on the position of the barrier element 18 relative to the bedding plane. When the barrier is raised to its maximum, the extender 34 extends from the cavity so that the useful height of the barrier is at a maximum. On the contrary, when the barrier is in its lowest position, the extender 34 is retracted inside the cavity so that sufficient distance is maintained between the bottom edge of the barrier and the floor.

Figure 1:
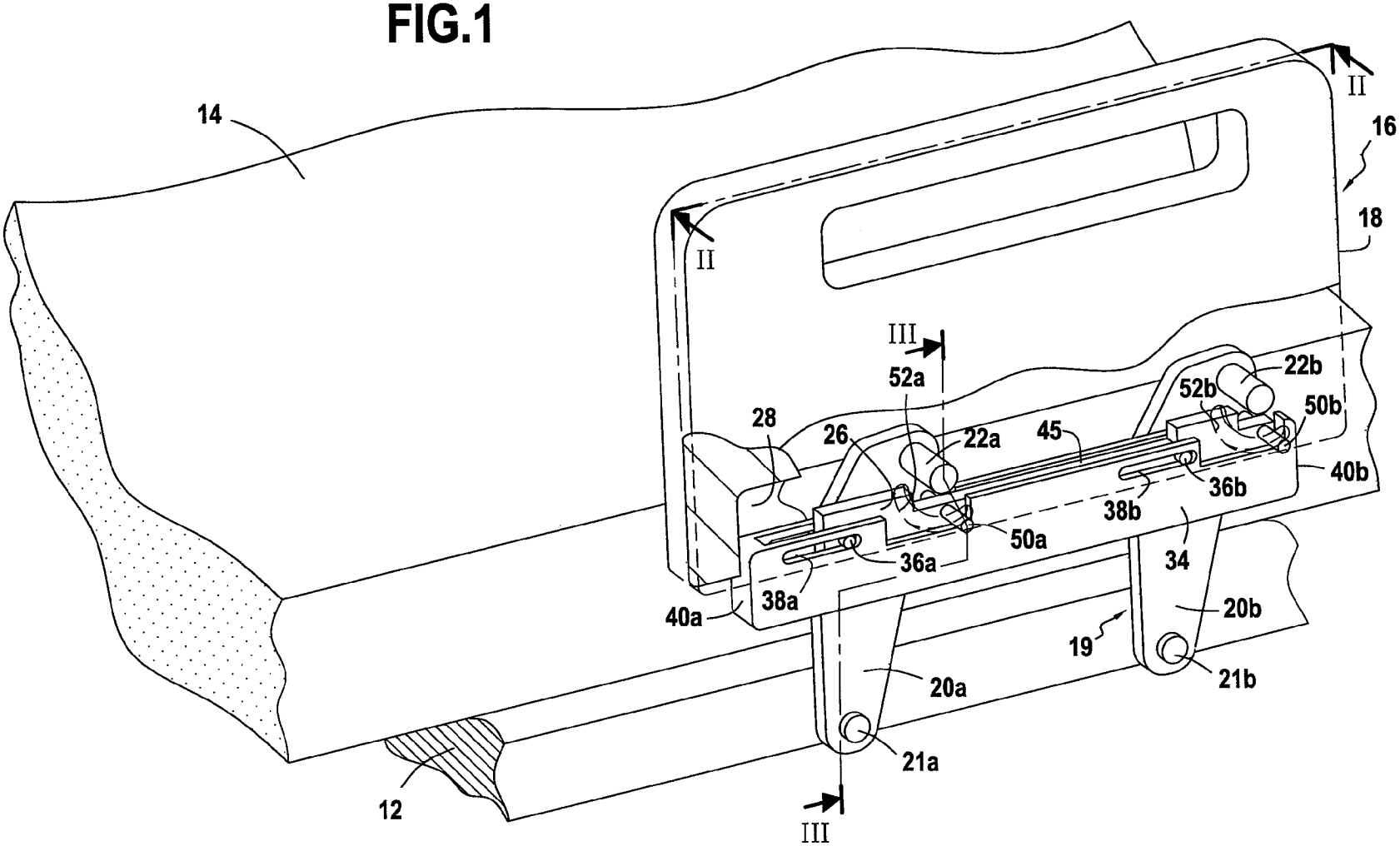
FIG. 1 is a partially cutaway diagrammatic perspective view of a bed fitted with a retractable side barrier in accordance with this disclosure.
Figure 2:
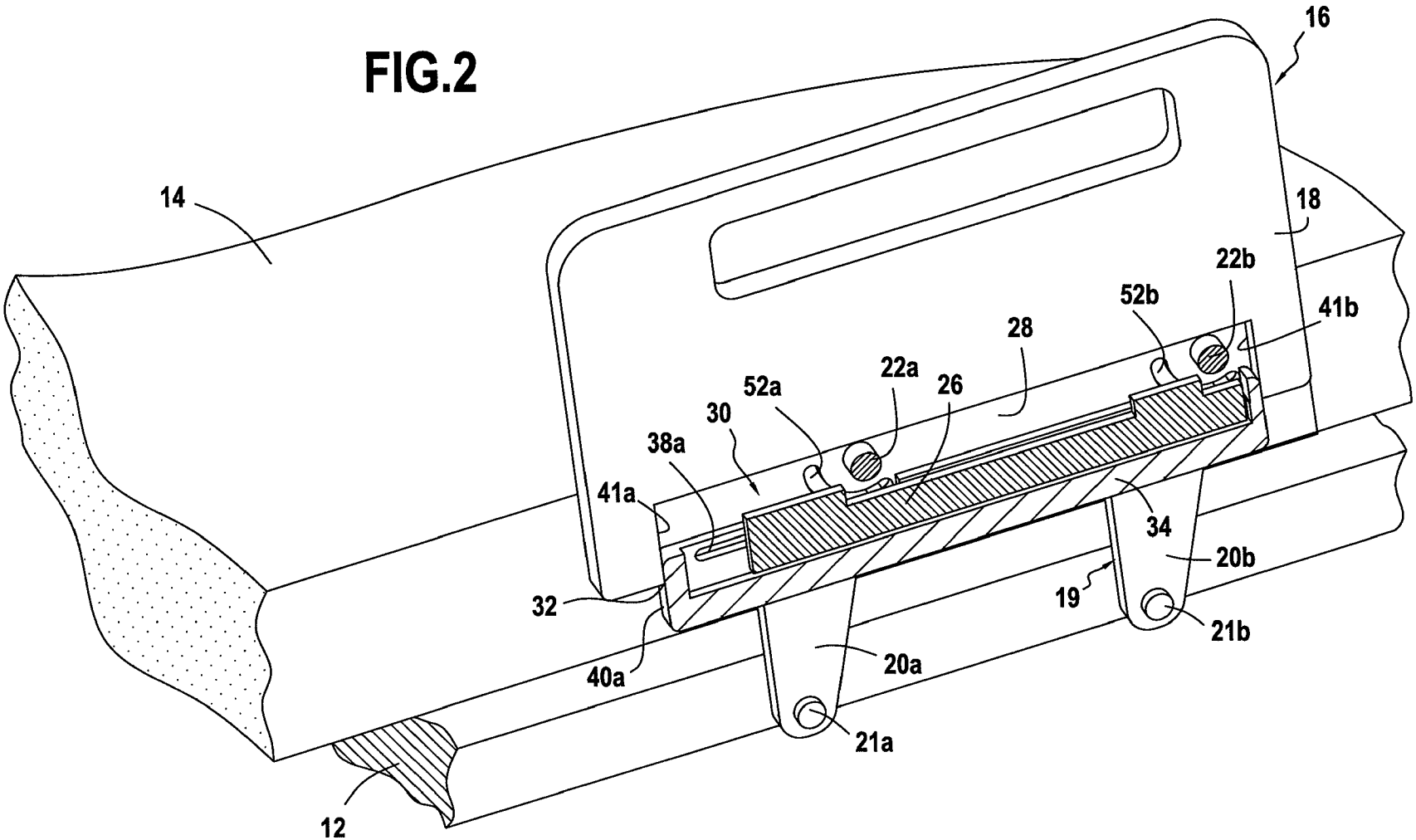
FIG. 2 is a section II-II of FIG. 1.
Figure 3:
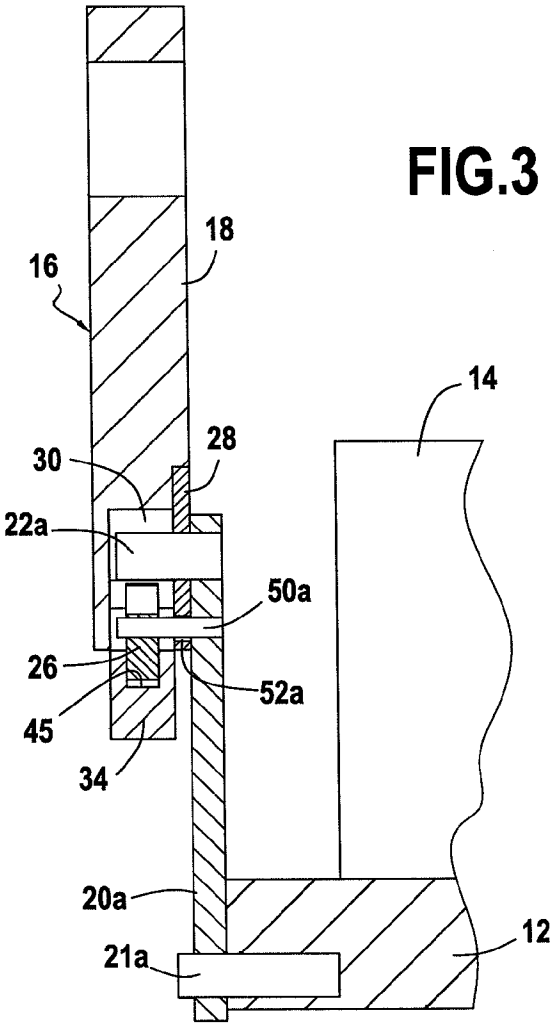
FIG. 3 is a broken section III-III of FIG. 1.

As can be seen in FIGS. 1 to 3, the deployment bar 26 is engaged in an elongate middle slot 45 of said extender. Each of the two pins 36*a*, 36*b* carried by the deployment bar extends on either side thereof, and the corresponding slot 38*a*, 38*b* defined in the wall of the extender comprises two slots extending on either side of said middle slot 45. In the example shown in FIGS. 1 to 3, each arm 20*a*, 20*b* carries a hinge pin 50*a*, 50*b* connected to said deployment bar. This pin passes through a curved slot 52*a*, 52*b* formed through the wall of the support 28. The shape and the dimensions of such a slot are determined so that the hinge pin 50*a*, 50*b* that passes through it does not encounter the wall of the support. The bottom abutment of the barrier may nevertheless take place against the slots.

Figure 4:
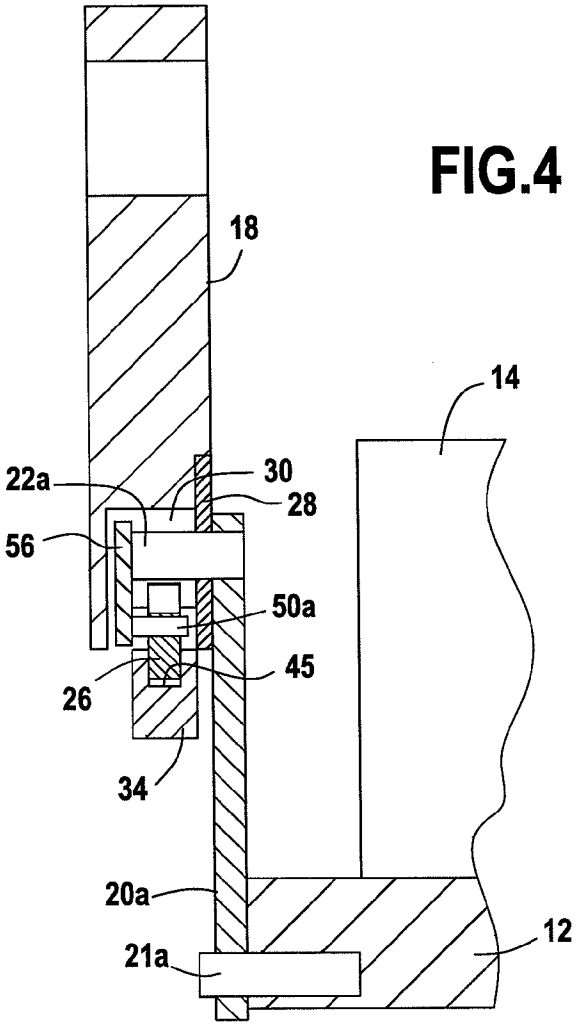
FIG. 4 is a view similar to FIG. 3, showing a variant.

In a variant, it is possible to adopt the configuration shown in FIG. 4. The hinge between each arm 20*a* (or 20*b*) and the barrier element 18 then comprises a hinge pin 22*a* (or 22*b*) that is engaged in said cavity 30. This pin carries an inner support 56 that is fully received inside the cavity. Naturally, the arm 20*a* (or 20*b*), the pin 22*a* (or 22*b*), and the inner support 56 are secured to one another, the assembly being hinged relative to the frame of the bed. The inner support 56 carries a hinge pin 50*a* (or 50*b*) connected to said deployment bar 26. Thus, said deployment bar 26 is hinged between the two pins 50*a*, 50*b* carried by the two inner supports 56. In this way, the support wall 28 no longer includes a curved slot as in the above-described embodiment, and this is favorable from a hygiene point of view.

In yet another variant, the top ends of the two arms could be engaged in the cavity.

Figure 8:
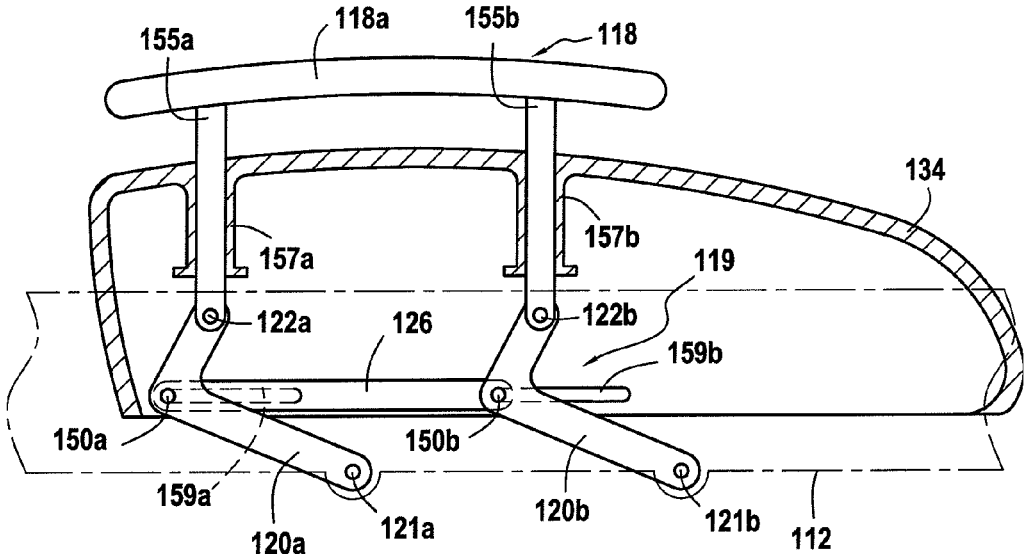
FIGS. 8 and 9 are diagrams showing another embodiment in accordance with this disclosure, the device being shown respectively in its high position and in its low position.
Figure 9:
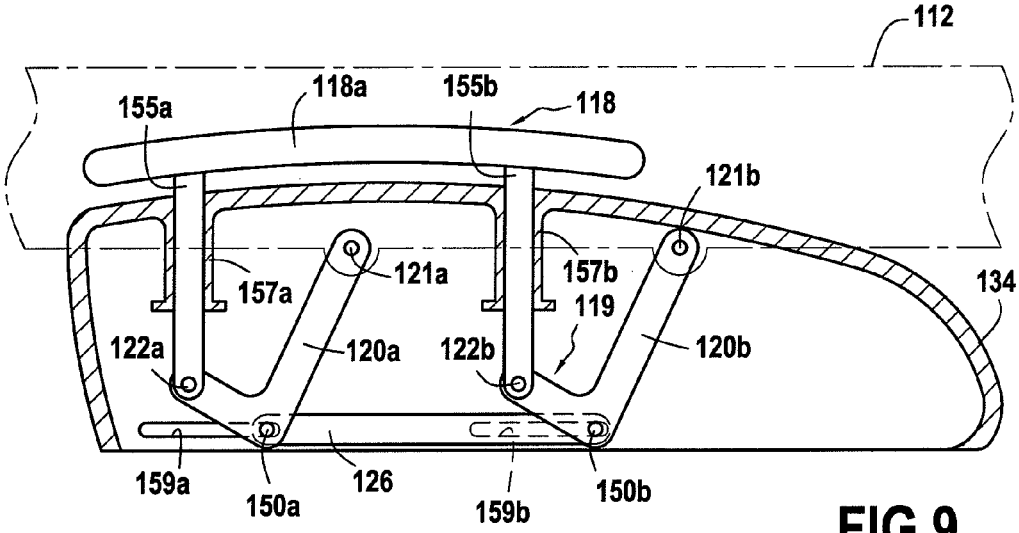

By analogy with the above, the embodiment shown in FIGS. 8 and 9 comprises a main barrier element 118 having a ramp 118*a* forming a portion of a deformable parallelogram mechanism 119 hinged to the frame 112 of the bed. This mechanism has two parallel pivot arms 120*a*, 120*b* each comprising a hinge 121*a*, 121*b* with the frame 112 and a hinge 122*a*, 122*b* with the main barrier element. A deployment bar 126 is hinged between the arms 120*a*, 120*b* by means of two hinge pins 150*a*, 150*b*. In this example, the extender 134 is a hollow structure housing in particular the deployment bar 126 and two vertical uprights 155*a*, 155*b* of the main barrier element 118.

The hinges 122*a*, 122*b* are situated respectively at the bottom ends of these uprights 155*a*, 155*b*. The uprights slide in guides 157*a*, 157*b* of the extender 134.

The pins 150*a*, 150*b* are also engaged in slots 159*a*, 159*b* of the extender 134 to form a sliding connection as in the above example, between said extender 134 and the deployment bar 126. The dynamics of this variant are similar to those of the above embodiment, the ramp 118*a* of the main barrier element 118 being further away from the top edge of the extender 134 when the system is in its high position (FIG. 8) than when it is in its low position (FIG. 9).

The invention claimed is:

1. A bed with a retractable side barrier of the type comprising a main barrier element associated with a deformable parallelogram mechanism hinged to a frame of the bed or to an analogous structure, said mechanism comprising two parallel arms, each including a hinge to said frame and a hinge to said main barrier element, a deployment bar being additionally hinged between said arms, wherein said mechanism is associated with a bottom extender attached to said deployment bar by a sliding connection, and wherein said extender is constrained to slide along vertical guide means carried by said main barrier element, wherein said sliding connection comprises two pins each secured to said deployment bar and engaged in respective slots of said extender.

2. A bed according to claim 1, wherein the slots of the extender comprise at least one of a curved slot and a straight slot.

3. A bed with a retractable side barrier of the type comprising a main barrier element associated with a deformable parallelogram mechanism hinged to a frame of the bed or to an analogous structure, said mechanism comprising two parallel arms, each including a hinge to said frame and a hinge to said main barrier element, a deployment bar being additionally hinged between said arms, wherein said mechanism is associated with a bottom extender attached to said deployment bar by a sliding connection, and wherein said extender is constrained to slide along vertical guide means carried by said main barrier element, wherein said guide means are constituted by a cavity including a longitudinal opening along a bottom edge of said main barrier element and the cavity housing a top portion of said extender, the extender being in sliding contact with internal vertical walls of said cavity which vertical walls serve as the vertical guide means.

4. A bed according to claim 3, wherein said cavity also houses said deployment bar.

5. A bed according to claim 3, wherein the extender has ends that are longitudinally spaced apart and that are in sliding contact with corresponding end walls of said cavity.

6. A bed according to claim 3, wherein said mechanism includes a longitudinal support fastened to a bottom end of said main barrier element and defining at least part of said cavity presenting said longitudinal opening, and wherein said extender extends partially beyond said longitudinal opening.

7. A bed according to claim 6, wherein said deployment bar is engaged in an elongate middle slot of said extender, and further comprising two pins that are associated with said deployment bar and that pass through two parallel slots in said extender.

8. A bed according to claim 6, wherein the two parallel arms are outside said cavity defined by said support.

9. A bed according to claim 8, wherein each arm carries a hinge pin connected to said deployment bar and passing through a curved slot formed through a wall of said support.

10. A bed according to claim 8, wherein the hinge to said barrier element of each arm includes a hinge pin that engages in said cavity and carries an inner support secured thereto, said inner support, installed in said cavity, carrying a hinge pin connected to said deployment bar.

11. A bed comprising a frame, a main barrier element, a pair of parallel arms, each of the pair of parallel arms being pivotably coupled to the frame and pivotably coupled to the main barrier element, a deployment bar coupled to each of the pair of parallel arms, and a bottom extender slidably attached to the deployment bar, the bottom extender being constrained to slide along a vertical guide of the main barrier element, wherein the bottom extender includes a pair of slots and further comprising two pins coupled to the deployment bar and received in respective slots of the bottom extender.

12. The bed of claim 11, wherein the pair of slots comprises one of a pair of straight slots and a pair of curved slots.

13. A bed comprising a frame, a main barrier element, a pair of parallel arms, each of the pair of parallel arms being pivotably coupled to the frame and pivotably coupled to the main barrier element, a deployment bar coupled to each of the pair of parallel arms, and a bottom extender slidably attached to the deployment bar, the bottom extender being constrained to slide along a vertical guide of the main barrier element, wherein main barrier element has a cavity open at a bottom edge of the main barrier element, the bottom extender is received in the cavity, and the vertical guide comprises internal vertical walls of the cavity.

14. The bed of claim 13, wherein at least a portion of the deployment bar is situated in the cavity.

15. The bed of claim 13, wherein the bottom extender has ends in sliding contact with the internal vertical walls of the cavity.

16. The bed of claim 13, wherein the bottom extender extends downwardly out of the cavity.

17. The bed of claim 16, wherein the parallel arms situated outside the cavity of the main barrier element.

18. The bed of claim 17, wherein each of the parallel arms carries a hinge pin that is connected to the deployment bar and that passes through a respective curved slot of the main barrier element.

19. A bed comprising frame, a main barrier element, a pair of parallel arms, each of the pair of parallel arms being pivotably coupled to the frame and pivotably coupled to the main barrier element, a deployment bar coupled to each of the pair of parallel arms, and a bottom extender slidably attached to the deployment bar, the bottom extender being constrained to slide along a vertical guide of the main barrier element, wherein the bottom extender includes a cavity in which at least a portion of the deployment bar is situated.

20. The bed of claim 19, wherein the deployment bar moves longitudinally within the cavity of the bottom extender as the main barrier element is raised and lowered.

* * * * *